United States Patent [19]

Driver

[11] 4,227,584

[45] Oct. 14, 1980

[54] DOWNHOLE FLEXIBLE DRIVE SYSTEM

[76] Inventor: W. B. Driver, 19 Sheridan Rd., Arnold, Md. 21012

[21] Appl. No.: 970,919

[22] Filed: Dec. 19, 1978

Related U.S. Application Data

[63] Continuation-in-part of Ser. No. 827,689, Aug. 25, 1977, Pat. No. 4,143,722.

[51] Int. Cl.[2] ..... E21B 7/04; E21B 1/06

[52] U.S. Cl. ..... 175/95; 175/61; 175/104; 175/325

[58] Field of Search ..... 175/61, 73, 74, 75, 175/76, 79, 81, 104, 107, 95, 320, 325

[56] References Cited

U.S. PATENT DOCUMENTS

| | | | |
|---|---|---|---|
| 1,666,461 | 4/1928 | Lord | 175/95 |
| 1,826,634 | 10/1931 | Pippin | 175/325 X |
| 1,850,403 | 3/1932 | Lee | 175/94 |
| 1,923,015 | 8/1933 | Sandstone | 175/104 X |
| 2,531,120 | 11/1950 | Feaster | 175/104 |
| 2,589,534 | 3/1952 | Buttolph | 175/325 X |
| 2,829,864 | 4/1958 | Knapp | 175/76 X |
| 3,159,222 | 12/1964 | Hammer et al. | 175/107 |
| 3,326,008 | 6/1967 | Baran et al. | 175/73X |
| 3,971,450 | 7/1976 | Fox | 175/325 |
| 3,999,901 | 12/1976 | Tschirky | 175/107 |

FOREIGN PATENT DOCUMENTS

| | | | |
|---|---|---|---|
| 1247454 | 10/1960 | France | 175/79 |

*Primary Examiner*—Ernest R. Purser
*Assistant Examiner*—Richard E. Favreau

[57] ABSTRACT

An improved downhole system for operating a drill bit around a small radius of bend in the directional drilling of curved holes from a vertical well hole in an oil or gas formation. The system is comprised of a plurality of double shaft downhole motors assembled in line and their shafts are connected by a flexible coupling. A flexible assembly encloses the area between the motors and provides a means for drilling fluids to be pumped through the system to a drill bit. The system can be constructed of either electrical motors or fluid turbine motors which can operate from drilling fluids pumped down a drill pipe string.

3 Claims, 7 Drawing Figures

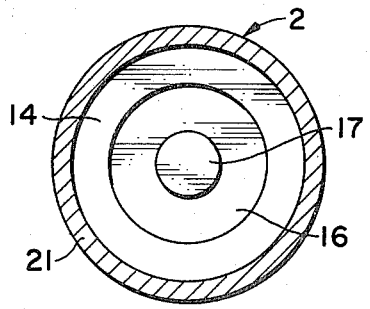
FIG. 3
FIG. 4
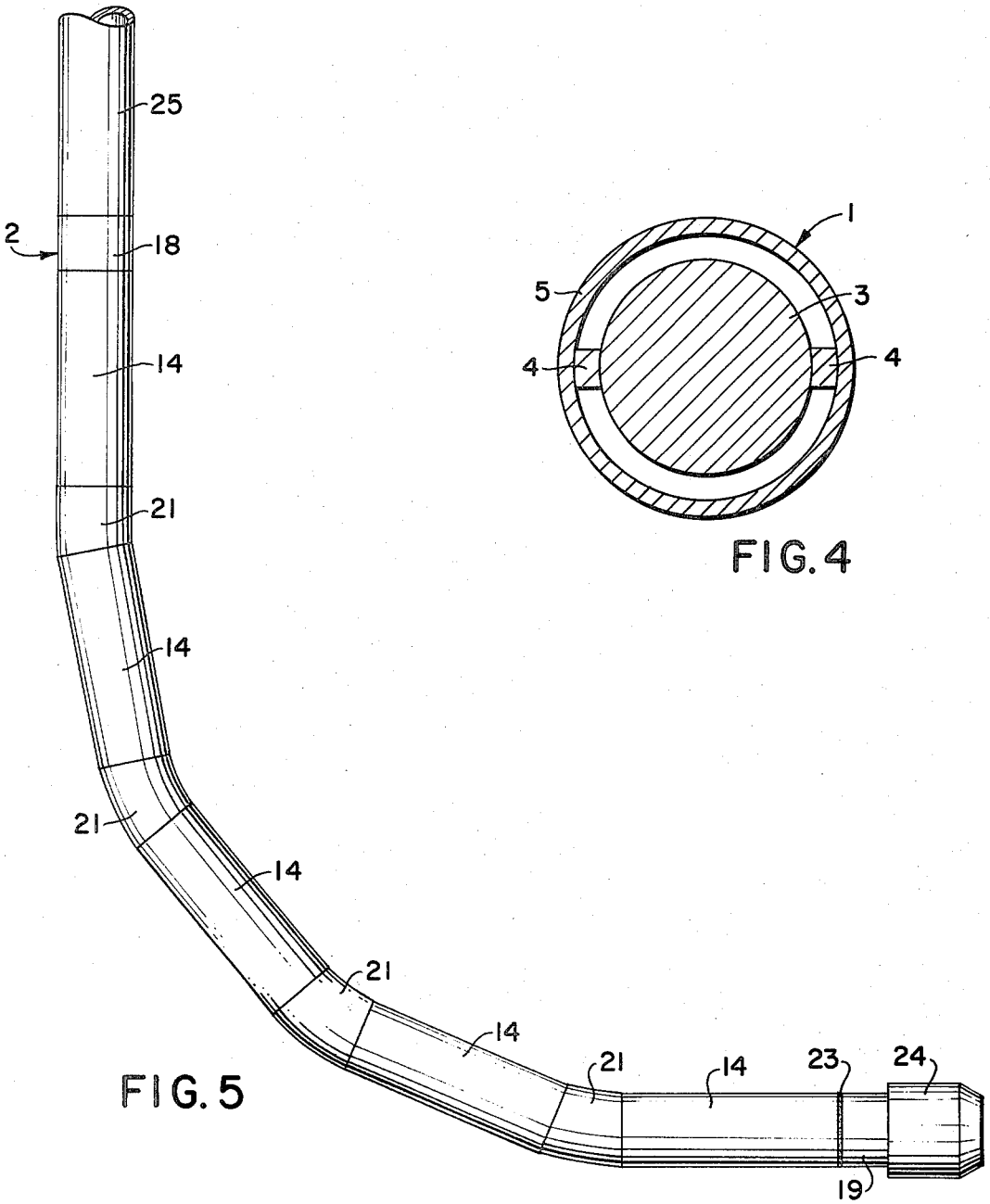
FIG. 5

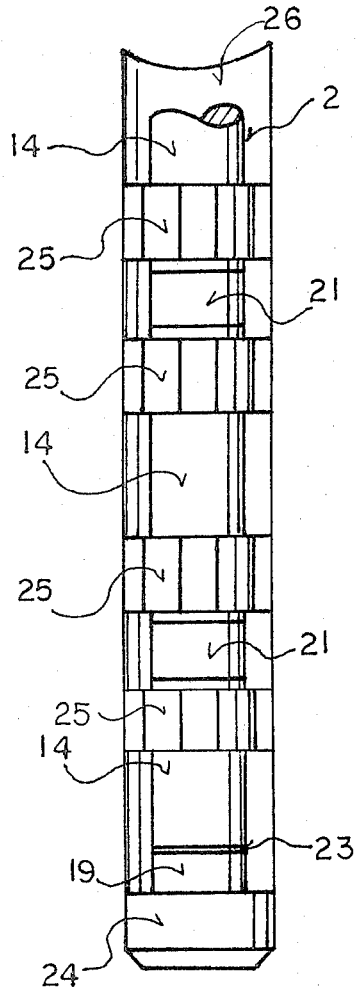
FIG. 6
FIG. 7
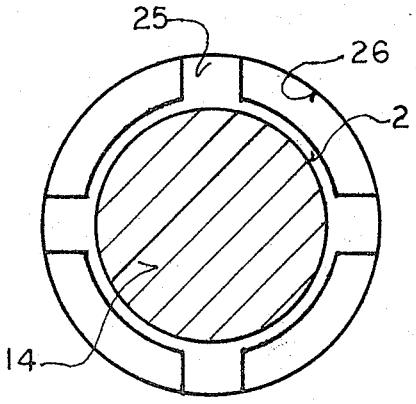

DOWNHOLE FLEXIBLE DRIVE SYSTEM

This application is a continuation-in-part of my application titled: Downhole Flexible Drive System, filing date 8/25/77, Serial No. 827,689 and now Patent No. 4,143,722 issued Mar. 13, 1979.

BACKGROUND OF THE INVENTION

1. Field of the Invention

This invention relates to downhole motors or other downhole driving means for drill bits.

2. Prior Art

Present directional drilling systems when used for drilling of horizontal holes or angle holes from a vertical well can only deviate from the vertical a few degrees per hundred feet and to drill a curved hole from the vertical to a horizontal position requires the radius of bend of the curved hole to be several hundred feet. This means that a considerable amount of formation in the immediate vicinity of the vertical well hole is not affected by directional drilling. The use of downhole motors has reduced the radius of bend of a curved hole from the vertical to the horizontal but they are not as effective as they should be because of their long length which restricts their uses around curved holes with small radius of bends. So a flexible drive system is needed that can operate a drill bit in the drilling of a curved hole with a small radius of bend.

Downhole motors have to be very long in length to develop the horse power required to drive a drill bit because they can only be a few inches in diameter. Also present downhole motors can only operate in curved holes with a radius of bend much greater than the length of the motor, whereas the downhole flexible drive system will be able to operate in curved holes with radius of bends equal to or less than the length of the downhole flexible drive system.

SUMMARY OF THE INVENTION

It is an object of the invention to provide a downhole flexible drive system which cn be attached to the downhole end of a drill pipe string and operate a drill bit in the drilling of a curved hole with a small radius of bend. It is an object of the invention to provide a downhole flexible drive system that uses a plurality of double shaft downhole motors assembled in line and their shafts connected by flexible couplings.

It is an object of the invention to provide a downhole flexible drive system with a flexible assembly that can support a plurality of downhole motors in line and provide a flexible connection between the downhole motors so drilling fluids can be pumped through the system.

It is an object of the invention to provide a downhole flexible drive system that is operated by a plurality of double shaft downhole electrical motors.

It is an object of the invention to provide a downhole flexible drive system that utilizes a plurality of double shaft downhole fluid motors which can be operated by drilling fluids.

It is an object of the invention to provide a downhole flexible drive system with a length long enough to provide the horse power to drive a drill bit but still be able to operate around a small radius of bend of a curved hole.

It is an object of the invention to provide a downhole flexible drive system that can operate around a radius of bend of a curved hole equal to or less than the length of the downhole flexible drive system.

It is an object of the invention to provide a downhole flexible drive system with a flexible assembly that attaches a plurality of downhole motors end to end in line forming an assembly of motors and provides a three hundred and sixty degree flexible connection between the downhole motors so the downhole flexible drive system can be rotated while operating around the radius of bend of a curved hole.

DESCRIPTION OF THE DRAWINGS

In the accompanying drawings;

FIG. 3 illustrates a horizontal cross-sectional of a downhole flexible drive system which uses fluid motors. The downhole end of a fluid motor is shown.

FIG. 4 illustrates a horizontal cross-section of a downhole flexible drive system which uses downhole electrical motors.

FIG. 5 illustrates how a downhole flexible drive system would be flexed when operating a drill bit around the radius of bend of a curved hole.

FIG. 6 illustrates how centralizers are used near the flexible connections between downhole motors so the system will not be flexible in different directions when drilling weight is applied to the system while operating in a vertical well hole.

FIG. 7 illustrates how the centralizers connect to the system and maintain contact with the wall of a well hole.

DESCRIPTION OF THE PREFERRED EMBODIMENT

Figure 1:
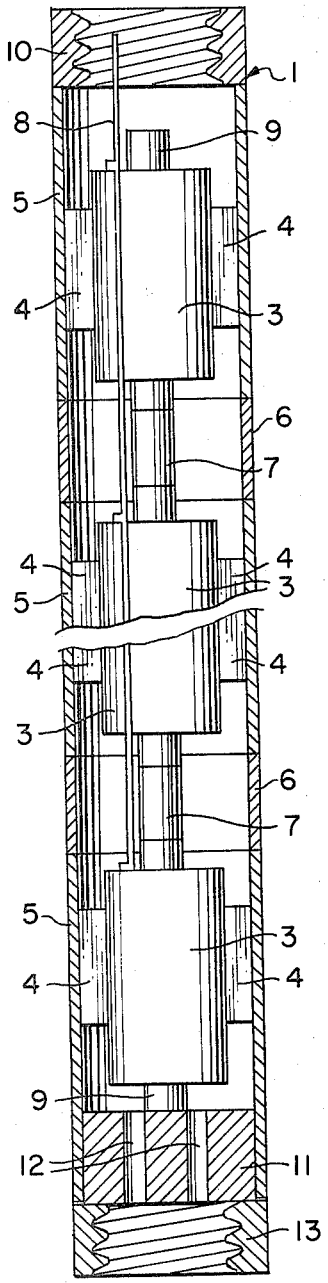
FIG. 1 illustrates a downhole flexible drive system that utilizes electrical motors. Sections of the system are shown with partial cross-sections.

In FIG. 1 a downhole flexible drive system 1 is shown and is powered by double shaft downhole electrical motors 3. The electrical motors 3 are assembled in line and the double shafts 9 of the electrical motors 3 are connected by flexible shafts 7 forming a flexible coupling between the electrical motors 3. Each electrical motor 3 housing is enclosed by a tube section 5. The electrical motors 3 are supported by a plurality of supports 4 so the axial center of the electrical motors 3 and the axial center of the tube sections 5 are the same. The supports 4 attach to the inside wall of the tube sections 5 and to the side of the electrical motors 3. The inside diameter of the tube sections 5 is larger than the outside diameter of the electrical motors 3 so drilling fluids can be pumped through the tube sections 5 and electrical power line 8 can be laid through the tube sections 5 to provide electrical power to the electrical motors 3. Flexible tubes 6 are attached to the respective ends of tube sections 5 between the electrical motors 3 forming a flexible connection between the electrical motors 3 to support the structure of the drive system 1 and provide a means for driling fluids to be pumped through the drive system 1. The flexible shafts 7 and flexible tubes 6 together form a flexible section in the drive system 1 so the drive system 1 can bend around a radius of bend of a curved hole and still provide power to a drill bit, see FIG. 5. The downhole end of the double shaft 9 of the electrical motor 3 at the downhole end of the assembled electrical motors 3 is attached to drive shaft 11. A plurality of holes 12 are constructed through the length of the drive shaft 11 so drilling fluids can be pumped through the drive shaft 11. The tube section 5 which encloses the housing of the electrical motor 3 whose double shaft 9 is attached to drive shaft 11 is long enough in length to enclose most of the length of drive shaft 11. The downhole end of drive shaft 11 is attached to downhole tool joint 13 so the drive system 1 can be attached to a drill bit or other tools.

Figure 2:
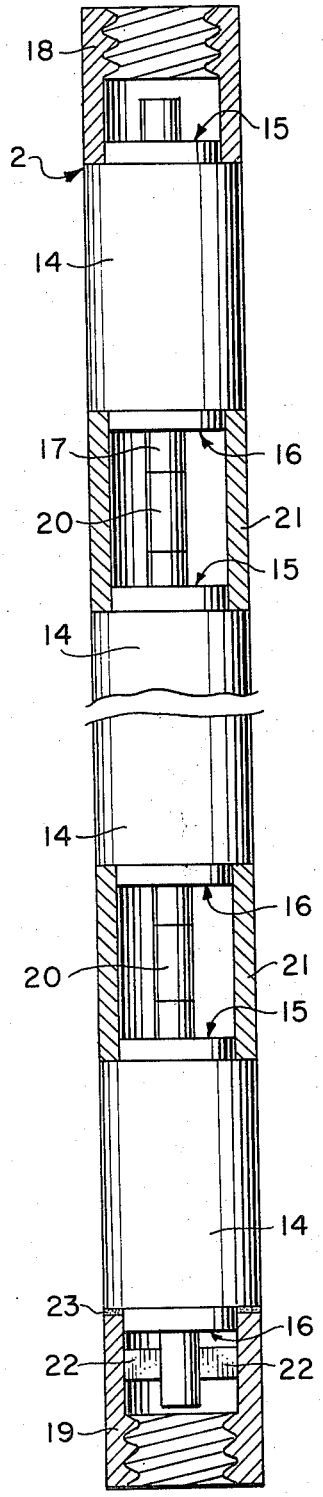
FIG. 2 illustrates a downhole flexible drive system that utilizes fluid motors. Sections of the system are shown with partial cross-sections.

The diameter of drive shaft 11 is large enough to be in contact with the inside wall of the tube section 4 but still be able to turn and operate. Uphole tool joint 10 is attached to the uphole end of the tube section 5 at the uphole end of drive system 1 so drive system 1 can be attached to the downhole end of a drill pipe string similar to the illustration as shown in FIG. 5. In FIG. 2 downhole flexible drive system 2 is shown. The drive system 2 utilizes a plurality of double shaft downhole fluid motors 14 which are operated by drilling fluids pumped through the fluid motors 14. The fluid motors 14 are constructed so the double shafts 17 of fluid motors 14 extend outside the fluid motors 14 through the intake port 15 and output port 16 of each fluid motor 14. The plurality of fluid motors 14 are assembled in line with the downhole end of the double shafts 17 being connected by a flexible shaft 20 to the respective uphole end of the double shaft of the next fluid motor 14. The flexible shaft 20 provides a flexible coupling between each fluid motor 14. Flexible tubes 21 connect the respective uphole and downhole ends of the fluids motors together forming a flexible connection between fluid motors 14 that enclose the flexible shafts 20 and the respective output ports 16 and intake ports 15. The flexible tubes 21 support the structure of the drive system 2 and provides a way for drilling fluids to be pumped through the assembly of fluid motors 14. The uphole end of the fluid motor 14 at the uphole end of the assembled fluids motors is attached to an uphole tool joint 18 so the uphole end of the drive system 2 can be connected to the downhole end of drill pipe string 25 as shown in FIG. 5 and drilling fluids can be pumped through the drive system 2. FIG. 3 is a horizontal cross-section of a flexible tube 21 and drive system 2 showing the downhole end of a fluid motor 14 and how the flexible tube 21 encloses the output port 16. The downhole end portion of the double shaft 17 of the fluid motor 14 at the downhole end of the assembly of fluid motors is connected by connecting supports 22 to the inside wall of downhole tool joint 19 which is used to attach the drive system 2 to drill bit 24 as shown in FIG. 5.

Connecting supports 22 support downhole tool joint 19 so the axial center of downhole tool joint 19 and the axial center of the respective double shaft 17 will be the same. The inside diameter of downhole tool joint 19 is large enough to enclose the output port 16 of the respective fluid motor 14 but smaller than the overall diameter of the fluid motor 14. The uphole end of downhole tool joint 19 is interfaced with the downhole end of the respective fluid motor 14 through seal 23 which is in contact with the downhole end of the respective fluid motor 14 and the uphole end of downhole tool joint 19 and keeps drilling fluids from flowing between the downhole end of the respective fluid motor 14 and the uphole end of the downhole tool joint 19 when drilling fluids are being pumped through drive system 2 and downhole tool joint 19 is rotating.

The drive system 2 would have an advantage over drive system 1 in being more simple in construction and operation in shallow depths. For drilling at deep depths drive system 1 would have an advantage over drive system 2 because drive system 1 could provide more power and would not lose efficiency due to high pressure in the well hole.

For stability of downhole flexible drive system 1 and downhole flexible drive system 2, centralizers 25 will be used with flexible drive systems 1 and 2. See FIG. 6 and FIG. 7. As shown centralizers 25 are placed on each side of flexible tube 21 near flexible tube 21 so flexible downhole system 2 will not buckle in different directions when drilling weight is applied particularly as shown in a vertical well hole 26. Centralizers 25 would make contact with the wall of well hole 26 and hold flexible drive system 2 in the center of well hole 26. A centralizer 25 would be placed on the uphole side and downhole side of each flexible tube 21 near the respective flexible tube 21, except for the downhole side of the flexible tube 21 on the last downhole flexible tube 21 so the drill bit 24 can be more readily deflected by a curved hole or deflecting tool. Though not shown centralizers 25 will be used on the uphole and downhole side of flexible tube 6 near flexible tube 6 in flexible drive system 1 the same way they are used with flexible drive system 2.

The flexible shaft 7 and flexible tube 6 of flexible drive system 1 and the flexible shaft 20 and flexible tube 21 of flexible drive system 2 provides three hundred and sixty degrees flexible connections between their respective electrical motors 3 and fluid motors 14 so flexible drive system 1 and flexible drive system 2 can be rotated while operating around a curved hole to increase drilling capability and flexibility and be spin stabilized.

The flexible drive system 2 can also be operated to drill a curved hole from a vertical well hole by using a whipstock or other related deflecting tool common to the petroleum industry to deflect the flexible drive system 2 in the direction the curved hole is to be drilled. Drilling weight applied to flexible drive system 2 would force flexible drive system 2 against the deflecting tool since the deflecting tool would be at an angle to the vertical. As the curved hole is being drilled, drilling weight applied to flexible drive system 2 would force flexible drive system 2 against the outside radius of bend of the curved hole, so flexible drive system 2 would follow through a curved hole being drilled without flexing. For drilling curved holes with small radius of bends, the diameter of drill bit 24 would be considerably larger than the diameter of flexible drive system 2 so the fluid motors 14 can move through the curved hole. Also the drill pipe string 25 would rotate and spin stabilize flexible drive system 2 which would also keep flexible drive system 2 from flexing.

For drilling straight horizontal holes from a curved hole the diameter of drill bit 24 would only be slightly larger than the diameter of flexible drive system 2 and the horizontal hole being drilled would act as a casing and eliminate any serious flexing of flexible drive system 2. Also the drill pipe 25 would rotate and spin stabilize flexible drive system 2 to eliminate the flexing effects. Flexible drive system 1 would operate the same as flexible drill system 2.

I claim:

1. A downhole flexible drive system which attaches to the downhole end of a drill pipe string and operates a drill bit for the drilling of a curved hole in earth formations and drilling fluids can be pumped through the downhole flexible drive system and the downhole flexible drive system comprises: an assembly of motors comprising a plurality of double shaft downhole motors assembled in line a three hundred and sixty degree flexible connection connects the respective ends of said double shafts of said motors forming a flexible joint between said motors, a three hundred and sixty degree flexible assembly constructed to said motors and encloses said flexible connection forming a flex point in said drive system and supports the structure of said drive system and providing a means for drilling fluids to be pumped through said system, an uphole tool joint attached to the uphole end of said system so said drive system can be attached to said drill pipe string and receive drilling fluids from said drill pipe string, a downhole tool joint, a connecting mechanism for connecting said downhole tool joint to the downhole end of said drive system so said drive system can be attached to said drill bit and said motors can operate said drill bit, a plurality of centralizers, a centralizer attached around said system on the uphole side and downhole side of each said flexible connection near said flexible connection.

2. In claim 1 said assembly of motors being comprised of a plurality of double shaft downhole electrical motors, a flexible shaft connecting the respective downhole ends and uphole ends of said double shafts of said electrical motors providing said three hundred and sixty degree flexible connection between said electrical motors, said flexible assembly comprising a plurality of tube sections each said tube section enclosing a housing of said electrical motor, inside diameter of said tube sections being larger than the outside diameter of said electrical motors, a plurality of supports attached to the inside wall of each said tube sections connects to the respective electrical motor and supports said electrical motors so the axial center of said tube sections and said electrical motors will be the same, a plurality of flexible tubes, each said flexible tube connecting the respective ends of said tube sections between said electrical motors enclosing said flexible shaft and providing a means for drilling fluids to be pumped through said system and with said flexible shaft providing a three hundred and sixty degree flexible point in said system between said electrical motors, a drive shaft, uphole end of said drive shaft connected to the downhole end of said double shaft of the electrical motor located at the downhole end of said assembly of motors, said tube section which encloses said housing of said electrical motor located at the downhole end of said assembly of motors being long enough in length to enclose all but the downhole end portion of said drive shaft, diameter of said drive shaft being large enough to be in contact with the inside wall of said tube section and still turn, downhole end of said drive shaft connected to the uphole end of said downhole tool joint, a plurality of holes constructed through the length of said drive shaft so said drilling fluids can be pumped through said drive shaft, uphole end of said tube section enclosing said electrical motor located at the uphole end of said assembly of motors connected to the downhole end of said uphole tool joint, an electrical power line extending down through said uphole tool joint between said electrical motors and the inside wall of said tube sections attaching to each said electrical motor and providing electrical power to each said electrical motor.

3. In claim 1 said assembly of motors being comprised of a plurality of double shaft downhole fluid motors, input port of said fluid motors constructed on the uphole end of said fluid motors, output port of said fluid motors being constructed on the downhole end of said fluid motors, double shaft of said fluid motors constructed to extend through the input port and output port of said fluid motors, a plurality of flexible shafts, each flexible shaft connecting the respective downhole end and uphole end of said fluid motor assembled in line providing said three hundred and sixty degree flexible connection between said fluid motors, said flexible assembly comprising a plurality of flexible tubes, each flexible tube connecting the interfacing ends of respective fluid motors assembled in line and enclosing said flexible shaft and the respective output port and input port of said fluid motors so drilling fluid can be pumped through said system and with said flexible shaft provide a three hundred and sixty degree flexible point between said fluids motors so said system will be flexible between said fluid motors, downhole end of said uphole tool joint being attached to the uphole end of said fluid motor located at the uphole end of said assembly of motors, a plurality of supports attached to the inside wall of said downhole tool joint attaches to the downhole end portion of the double shaft of the fluid motor located on the downhole end of said assembly of motors so the axial center of said double shaft and said downhole tool joint will be the same, inside diameter of said downhole tool joint being less than the overall diameter of said fluid motors, a seal interfaces the uphole end of said downhole tool joint with the downhole end of said fluid motor located at the downhole end of said assembly of motors so said drilling fluids will not flow through said interface when said downhole tool joint is turning.

* * * * *